United States Patent [19]

Linder

[11] 3,990,182

[45] Nov. 9, 1976

[54] ENTRANCE SECURITY

[76] Inventor: Peter J. Linder, 3109 Ramblewood Road, Ellicot City, Md. 21043

[22] Filed: Apr. 21, 1976

[21] Appl. No.: 678,919

[52] U.S. Cl. ..... 49/34; 70/18; 70/56

[51] Int. Cl.[2] ..... E01F 13/00

[58] Field of Search ..... 49/34, 9, 35; 160/327, 160/328; 70/423, 56, 18, 55

[56] References Cited

UNITED STATES PATENTS

| | | | |
|---|---|---|---|
| 353,368 | 11/1886 | Miller | 49/34 X |
| 1,244,404 | 10/1917 | Ankovitz | 70/56 |
| 2,856,220 | 10/1958 | Easley | 70/56 X |
| 3,765,197 | 10/1973 | Foote | 70/55 X |

*Primary Examiner*—Philip C. Kannan
*Attorney, Agent, or Firm*—Browdy and Neimark

[57] ABSTRACT

A cable is suspended across a private road or driveway, primarily in rural areas, between two trees or posts for entrance security. The cable is anchored in one post in a permanent manner at a first end, while the second end of the cable carries a fitting through which a padlock can be passed. This second end of the cable with the fitting is threaded through a hole in the second tree or post and through a hole in a plate of a padlock protector which is nailed in place on the far side of the second tree or post through which the fitting at the end of the cable has been threaded. The padlock protector constitutes an angulated section cut from a heavy gauge steel pipe.

9 Claims, 4 Drawing Figures

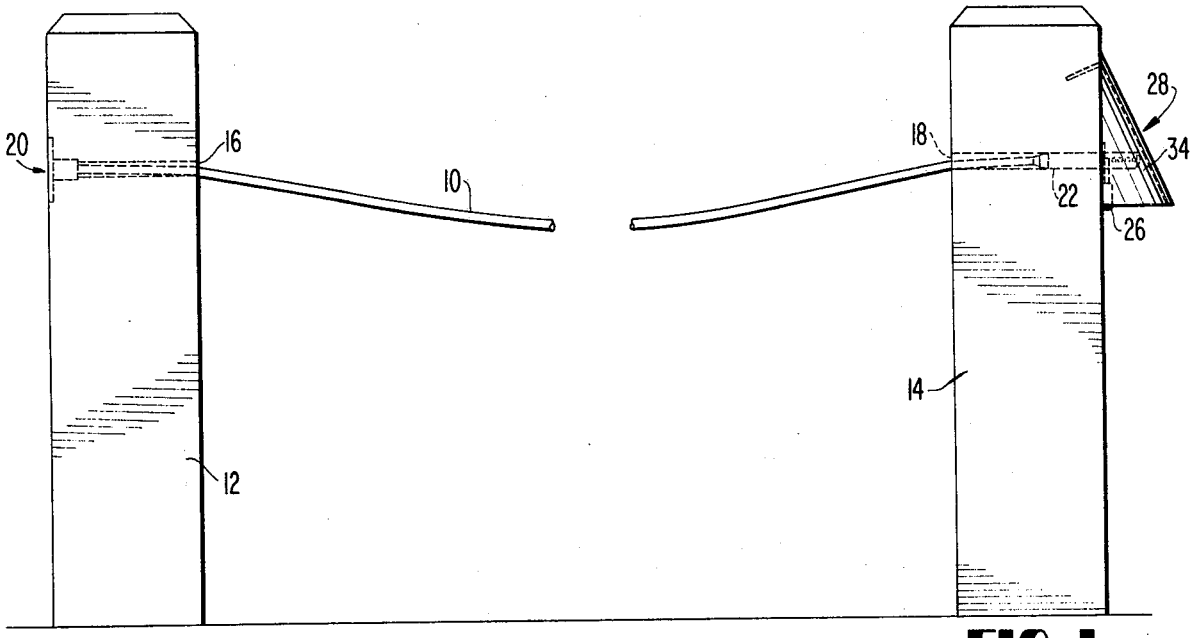
FIG 1
FIG 2
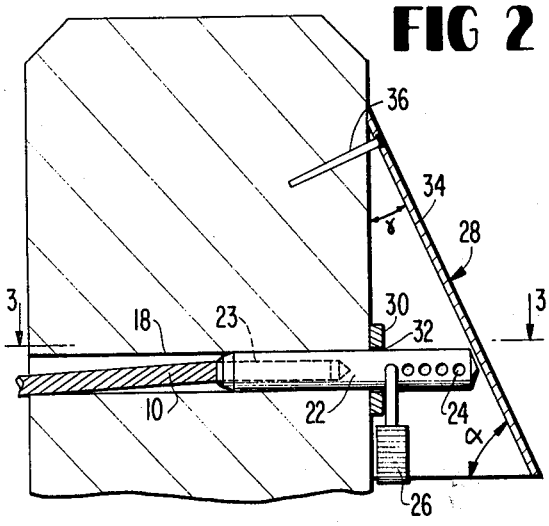
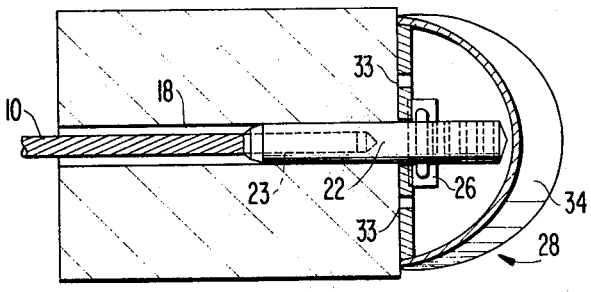
FIG 3
FIG 4
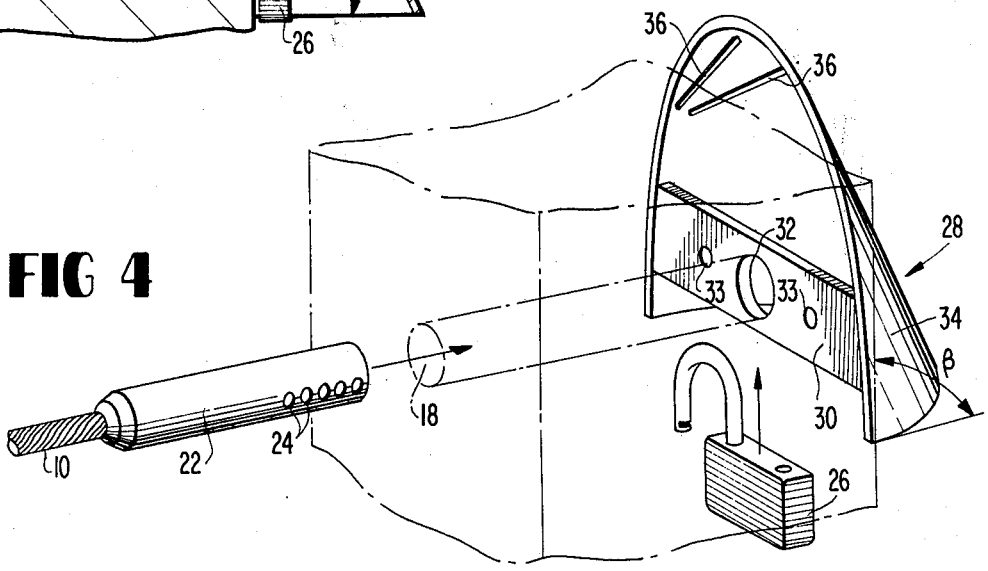

ENTRANCE SECURITY

FIELD OF THE INVENTION

The present invention relates to entrance security and, more particularly, to a device for preventing ingress of unauthorized vehicles onto private roads, particularly in rural areas.

BACKGROUND

Security presents a much more difficult problem in rural areas than in urban and suburban areas, in view of the absence of people to observe vandals and perpetrators of crime, and also in view of remoteness from police protection. Some recent problems in rural areas having included theft of forest products or personal property including timber, e.g., walnut logs, firewood, Christmas trees, berries, household effects, e.g., guns, electronic equipment and TV, and diesel oil, etc.; the discarding of trash on private rural roads, including household trash in bags, old automobiles, beer cans, bottles, etc. on lover's lanes; hunting without permission; vandalism including rutting roads in mud season thereby necessitating regarding, breaking into seasonal dwellings, damaging equipment such as logging equipment; and the starting of fires, such as by careless smokers, or even arson to cover theft.

Gates across private roads in rural areas are generally locked closed in a simple and inexpensive manner, commonly by employing a chain wrapped around the free-swinging end of the gate and gate post with the ends of the chain secured together by a padlock, or by using the well known hasp and staple arrangement secured by a padlock. Sometimes a chain is suspended between two posts or between two trees with padlocks at either end, or a double length of chain is used with the two ends being padlocked together.

Regardless, however, the padlocks are more often than not left unprotected from the weather, although leather or rubber hoods are occasionally used to cover the locks against the elements. These are not particularly durable and tear or wear out, especially after extensive periods of time in the open. More importantly, however, they are easily destroyed or removed by trespassers or vandals, leaving the locks exposed and subject to destruction.

Such unprotected padlocks are subject to damage and destruction by trespassers forcing them open to gain entrance through the gate. Methods used for forcing the locks include prying loose of a shackle from the locks or cutting the shackles. Such locks are commonly destroyed or broken loose merely with the use of hammer and chisel. Instead of forcing open the padlocks, trespassers sometime break the fastening devices secured by the padlocks, as by prying open or cutting the link in the chain wrapped around the gate and gate post or prying loose or cutting the staple where a hasp and staple fastening arrangement is used.

Unprotected padlocks or unattended gates across private roads in woods or forest areas are often damaged, particularly during the hunting season, by trespassers shooting at them to weaken the locks and mechanisms so that they may be more easily forced open, or by vandals shooting at the locks simply for the sake of target practice. Where chains are used, these may be easily destroyed using a bolt cutter.

One approach to solving the above problems is disclosed in the EASLEY U.S. Pat. No. 2,856,220 which involves an assembly for padlocking a gate in closed position including a cover protecting the padlock from weather and making it less susceptible to damage by prying, cutting or shooting. A latch bar fastener is provided in cooperation with the padlock cover for fastening the gate to the gate post, which is less susceptible to being broken by prying or cutting as are a link in a chain or a staple in a hasp and staple fastening device. The major defect of the EASLEY device is, however, that it requires a gate to support the padlock cover and, accordingly, the construction provided is considerably more expensive than suspending a chain or cable between two posts or two trees.

Padlock covers are known, such as those disclosed in the WILSON U.S. Pat. No. 416,433 of 1889 and the MUDGE U.S. Pat. No. 3,916,654. However, these are not adapted for usage in the environment contemplated.

SUMMARY

It is, accordingly, an object of the present invention to overcome the deficiencies of the prior art, such as indicated above.

It is another object of the present invention to provide for entrance security in a simple and inexpensive manner, particularly in rural areas.

It is another object of the present invention to provide a constructions for suspending a cable across a private road or the like in such as way as to provide entrance security in a highly effective, yet simple and inexpensive manner.

These and other objects in accordance with the present invention are achieved by suspending a cable across a road between two posts or trees, the cable being permanently anchored to a first such tree or post at its first end and carrying a fitting at its other end which is threaded through the second tree or post, the fitting having one or more apertures through which a padlock is placed. The assembly is completed by placing over the padlock and fitting on the far end of the second tree or post, a padlock protector which is in the form of an angulated section cut from a cylinder, the padlock protector also constituting an integral plate through which the fitting on the end of the cable passes.

The padlock protector thereby hangs over and shields the padlock both from the elements and from destruction by vandals or the like. However, the padlock can be reached from beneath and easily unlocked and removed in the normal manner. The shape of the padlock protector is such that its destruction is extremely difficult. The system thus provides excellent entrance security, there being no location or weak link which a vandal may attack. In this connection, it may be noted that cables are extremely difficult to cut — bolt cutters will not suffice — and thus, short of using an acetylene torch to cut the cable or cutting down the trees or posts, removal of the device of the present invention is impossible without means to unlock the lock.

For a better understanding of the invention a possible embodiment thereof will now be described with reference to the attached drawing, it being understood that this embodiment is to be intended as merely exemplary and in no way limitative. The following detailed description of such embodiment will also provide further objects and the nature and advantages of the instant invention.

BRIEF DESCRIPTION OF THE DRAWING

FIG. 1 is a front elevation, partly broken away and partly in section, showing an embodiment of the present invention;

FIG. 2 is an enlarged view, in section, of one of the portions of the device of FIG. 1;

FIG. 3 is a sectional view taken along line 3—3 of FIG. 2; and

FIG. 4 is an exploded perspective view of the construction shown in FIGS. 2 and 3.

DETAILED DESCRIPTION OF EMBODIMENT

FIG. 1 shows a device in accordance with the present invention wherein a cable 10 is suspended between a first post 12 and a second post 14. Such posts may constitute wooden 8 × 8 inch posts or even 12 × 12 inch posts, embedded in the ground in gravel and concrete. If desired, metal posts may be used, set in concrete, or framed posts, filled with gravel or concrete. However, normally the cable 10 will be suspended between a pair of mature trees.

In the illustrated embodiment, holes 16 and 18 are drilled perpendicular to the roadway through the two posts 12 and 14, respectively, or through the two trees if trees are used in place of the posts 12 and 14, it being understood that the holes 16 and 18 are drilled opposite one another. Normally, a hole of 1⅛ to 1¼ inch diameter is sufficient for purposes of the present invention. It is understood, of course, that the holes 16 and 18 should be made at a height which will prohibit the ingress of motor vehicles when the cable 10 is suspended between the posts 12 and 14; a height anywhere between 2 and 4 feet from the ground is normally adequate.

At its first end, the cable 10 is fastened into a T-shaped fitting 20 of suitable design. For example, the fitting may comprise a steel plate which forms the head of the T to which is welded a 2⅜ inch segment of a two-piece (total length 3¾ inches) drum socket assembly (Electroline Products, Superior Switchboard and Devices, Division of Union Metal Manufacturing Company, Canton, Ohio). A pair of spreading elements effect fastening of the cable within the fitting in a known manner. Such a two-piece fitting is one means of several for tightly securing the end of the cable.

The second end of the cable 10, shown in greater detail in FIGS. 2–4, is swaged into the hollow end 23 of a locking fitting 22, which may be formed of normal steel, case-hardened steel, stainless steel or even brass or other strong or resistant material. The locking fitting 22 is provided with one or more radially extending holes 24 passing from one side of the cylindrical locking fitting 22 to the other side, for the passage therethrough of a padlock 26 in usage, as shown in FIGS. 1 – 3.

The cable may be provided in standard lengths with the anchor plate 20 already connected at the first end and the locking fitting 22 at the second end. In such case, for installation, the locking fitting 22 is first threaded through the hole 16 of the first post 12 and the cable 10 is drawn all the way through such hole 16 until the anchor plate 20 is attached to the outside, away from the roadway, of the post 12 as shown in FIG. 1. A recess may be provided in the post 12 in which the anchor plate may lie, and in addition, holes may be provided in the plate portion of the anchor plate 20 through which nails may be pounded into the post 12; alternatively the nails may be stud-welded to the inside of the plate 20, thereby eliminating the holes.

Next, preparatory to placing the device in operation across a roadway, the locking fitting 22 may then be threaded through the hole 18 of the second post 14 and placed in position for locking as shown in the figures, the lock mechanism being attached to the outside, away from the roadway, of the second post 14.

An important feature of the present invention is the provision of a suitable lock protector 28. Such lock protector 28 is formed of two components, a plate or bar 30 containing a central hole 32 through which the locking fitting 22 passes preparatory to locking the cable 10 in place, and a protector portion 34 to which the plate or bar 30 is welded at its two ends. The plate 30 also contains two holes 33 through which lag screws may be driven. The protector portion 34 is of an unusual geometric shape in that it forms an angulated section cut from a cylinder. In practice, the portion 34 may be cut from steel pipe thereby providing a lock protector very resistant to destruction. In one example, the protector portion 34 is cut from a standard 8 inch diameter carbon-steel pipe having 0.188 inch wall thickness with the angle $\alpha$ being 65°, the angle gamma being 25° and the angle $\beta$ being 90°. Lighter gauge material affords reduced protection.

The lock protector is partially held in place by a pair of long, heavy duty nails 36 which are pounded into the post 14 through suitable holes in the top of the shield 34. If desired, said nails 36 may be welded on the inside of the shield 34. A pair of lag screws, e.g., ⅜ by 2½ inches, passed through the holes 33, also hold the lock protector 28 in place. But an additional means holding the lock protector 28 in place is the tension of the cable acting on the locking fitting 22 and the lock 26 applying pressure against the plate or bar 30.

The device of the present invention has a number of significant advantages. It is manufactured of wire rope, i.e., steel cable, steel casing, and standard steel bar stock, which are relatively inexpensive. There is a minimum of machine work required to construct the device. It is capable of being massproduced with the only variable being cable length, thereby greatly simplifying manufacturing and lowering the cost.

The device is adjustable at installation, depending on the cable length, to variable roadway widths, and the provision of a plurality of holes 24 and the variable of cable sag between the two posts provides further adjustment. The device of the present invention is extremely easy to install between trees with normal simple hand tools, and installation may be accomplished very quickly. The device is small and light and is capable of being shipped in one package by parcel post or delivery service throughout the United States. In addition, the security device of the present invention is extremely hard to destroy with normal hand tools. It is almost impossible to broach except with cable cutters, which are not readily available, an acetylene cutting torch, or a chain-saw to cut down the trees or posts which hold up the device.

In some instances it is desirable to provide locks at both ends of the cable; for example if two different parties have access to the restricted area, separate locks with separate keys for each of the parties may be provided, and if the security device is left unlocked at one end or the other, it is apparent which of the parties neglected his duty to re-lock the device. In such a case where double locks are desirable, the anchor plate assembly 20 is eliminated and locking fittings 22 and lock protectors 28 are provided at both ends of the cable 10.

The foregoing description of the specific embodiment will so fully review the general nature of the invention that others can, by applying current knowledge, readily modify such specific embodiments and/or adapt it for various applications, without departing from the generic concept, and, therefore, such adaptions and modifications should and are intended to be comprehended within the meaning and range of equivalents of the disclosed embodiment. For example, the padlock protector may be manufactured of a heavy steel stamping continuously curved in one direction, such as a section of a cone, or continuously curved in two directions covering the locking fitting from top, front and sides.

It is to be understood that phraseology or terminology employed herein is for the purpose of description and not of limitation.

What is claimed is:

1. A device for entrance security across a roadway, comprising:

a steel cable for suspending across the roadway, and having first and second ends;

connecting means at the first end of said cable, said connecting means being adapted to face the far side from the roadway of a first tree or post with the cable passing through the thickness of the tree or post;

an elongated locking fitting having first and second ends integrally connected at its first end to the second end of said cable, said locking fitting being adapted to be threaded through a second tree or post with the second end of said locking fitting projecting through to the far side from the roadway of the second tree or post, said locking fitting having at least one radially extending hole at its second end thereof through which a lock may be passed; and a padlock protector comprising a curved body and an integral plate having a hole passing therethrough, said padlock protector being adapted for placement on the far side from the roadway of the second tree or post with the second end of said locking fitting extending through the hole in said integral plate with said curved body covering said locking fitting from the top, front and sides.

2. A device in accordance with claim 1, wherein said connecting means at the first end of the cable comprises an anchor plate integrally connected to the first end of the cable.

3. A device in accordance with claim 2 wherein said curved body is cut from a steel pipe and said integral plate is welded at its two ends to said curved body.

4. A device in accordance with claim 2 wherein said curved body comprises a heavy gauge angulated section of a cylinder.

5. A device in accordance with claim 2 wherein said elongated locking fitting is a steel rod with its first end hollow into which the second end of said cable is swaged, the second end of said locking fitting having a plurality of holes extending radially therethrough and spaced axially from one another.

6. A device for blocking a roadway, comprising:

a steel cable having first and second ends and suspended across the roadway;

means to permanently anchor said steel cable at its first end, comprising a first massive support at one side of the roadway and having a hole passing therethrough substantially perpendicular to the roadway, and an anchor plate integrally connected to the first end of said cable, said cable extending into the hole through said first massive support and said anchor plate facing the far side from the roadway of said first massive support;

means to releasably anchor said steel cable at its second end, comprising a second massive support on the other side of the roadway and having a hole passing therethrough substantially perpendicular to the roadway, and an elongated locking fitting having first and second ends integrally connected at its first end to the second end of said cable, said cable and said locking fitting extending into the hole through said second massive support with the second end of said locking fitting extending out of the hole on the far side from the roadway of said second massive support, said locking fitting having at least one radially extending hole at its second end;

a padlock at the far side from the roadway of said second massive support, passing through the radially extending hole in said locking fitting; and padlock protecting means comprising a curved body and a plate integral therewith, said plate having an opening therethrough with said locking fitting extending through the opening of said plate, said plate being between said padlock and the far side from the roadway of said second massive support, and said curved body overlying and shielding said padlock and said locking fitting from the top, front and sides.

7. A device in accordance with claim 6, wherein said curved body comprises a heavy gauge angulated section of a cylinder.

8. A device in accordance with claim 6 wherein said curved body is cut from a steel pipe and said integral plate is welded at its two ends to said curved body.

9. A device in accordance with claim 7 wherein said elongated locking fitting is a steel rod with its first end hollow into which the second end of said cable is swaged, the second end of said locking fitting having a plurality of holes extending radially therethrough and spaced axially from one another.

* * * * *